US006012370A

United States Patent [19]

Kobayashi

[11] Patent Number: 6,012,370

[45] **Date of Patent: *Jan. 11, 2000**

[54] TOGGLE TYPE PUNCH DRIVING SYSTEM

[75] Inventor: Hiroshi Kobayashi, Aichi-ken, Japan

[73] Assignee: Murata Kikai Kabushiki Kaisha, Kyoto, Japan

[ * ] Notice: This patent issued on a continued prosecution application filed under 37 CFR 1.53(d), and is subject to the twenty year patent term provisions of 35 U.S.C. 154(a)(2).

This patent is subject to a terminal disclaimer.

[21] Appl. No.: 08/906,437

[22] Filed: Aug. 5, 1997

Related U.S. Application Data

[63] Continuation of application No. 08/489,114, Jun. 9, 1995, abandoned.

[30] Foreign Application Priority Data

Jun. 15, 1994 [JP] Japan ..... 6-157971

[51] Int. Cl.[7] ..... B26D 5/18

[52] U.S. Cl. ..... 83/543; 83/563; 83/628; 83/630; 72/451; 100/272; 100/283

[58] Field of Search ..... 83/305, 543, 563, 83/628, 630, 632, 527, 530, 604; 72/451; 100/272, 281, 286, 53, 271, 283

[56] References Cited

U.S. PATENT DOCUMENTS

| | | | |
|---|---|---|---|
| 3,529,502 | 9/1970 | Krynytzky et al. | 83/454 X |
| 3,724,308 | 4/1973 | Nichols | 83/630 X |
| 4,301,723 | 11/1981 | Borzym | 83/630 X |
| 4,303,012 | 12/1981 | McGlennon | 100/272 |
| 4,664,004 | 5/1987 | Randall | 83/630 X |
| 5,706,711 | 1/1998 | Ito | 83/630 X |

*Primary Examiner*—Clark F. Dexter
*Attorney, Agent, or Firm*—Armstrong, Westerman, Hattori, McLeland & Naughton

[57] ABSTRACT

In a toggle type punch driving system, the upper and lower ends of a bendable lever which can bend at an intermediate part thereof are pivotably connected to a fulcrum member and a ram respectively, and an advancing/retreating member for bending the lever is connected to the bendable part of the bending lever. The fulcrum member is formed as a vertically pivotable lever and it is borne by an upper/lower position switchover mechanism composed of a second bendable lever supported between a free end of the fulcrum member and frame, and an air cylinder. A retraction stroke of the ram necessary for tool change is assigned to the bending motion of the second bendable lever to diminish the punching stroke of the ram based on the bending motion of the bendable lever.

5 Claims, 2 Drawing Sheets

TOGGLE TYPE PUNCH DRIVING SYSTEM

This application is a continuation of application Ser. No. 08/489,114 filed Jun. 9, 1995, now abandoned.

BACKGROUND OF THE INVENTION

1. Field of the Invention

The present invention relates to a toggle type punch driving system to be mounted in a punch press.

2. Prior Art

Heretofore, a crank type mechanical punch press has been used as a punch driving system with a ram for vertical movement, wherein the lower end of a pitman arm connected to a crank shaft is connected to the ram.

According to such conventional mechanism, a single up-and-down movement of the ram is performed by one rotation of the crank shaft. Therefore, in order to shorten the machining time by high-speed punching, it is necessary to increase the rotating speed of the crank shaft. However, the rotating speed of the crank shaft is restricted by the rotating speed of a motor, bearing performance, etc. and it is difficult to increase the punching speed.

SUMMARY OF THE INVENTION

It is the object of the present invention to provide a toggle type punch driving system capable of effecting high-speed punching at an optimum torque and also capable of making tool changes easily.

According to the present invention, in a toggle type punch driving system provided with a first jointed lever which causes a ram to move up and down through bending motions at the joint and also provided with an advancing/retreating member connected to a jointed portion of the first jointed lever to bend the lever, there is used an upper/lower position switchover mechanism for switching over the position of the first jointed lever between a raised position and a lowered position together with a fulcrum member.

The ram is vertically movable to drive a punching tool. The first jointed lever is bendable at an intermediate joint portion thereof and is pivotably connected at upper and lower ends thereof to the fulcrum member and the ram, respectively. The advancing/retreating member, which is connected to an advance/retreat drive unit, causes the first jointed lever to assume an extended state at a middle point of an advance/retreat stroke.

The above fulcrum member may be a lever-like member supported vertically pivotably at a base end thereof by means of a frame. In this case, the foregoing upper/lower position switchover mechanism is provided with a second jointed lever connected pivotably at a lower end thereof to a free end of the fulcrum member and at an upper end thereof to the frame and bendable at an intermediate part thereof and is also provided with a bend angle changing means connected to the jointed portion of the second jointed lever to change the bend angle.

It is desirable that a stopper adapted to engage the second jointed lever in a bent state of the lever at a very small angle to prevent the extension of the lever be disposed near the jointed portion of the second jointed lever.

According to a toggle type punch driving mechanism, punching is performed twice by a single reciprocating motion of an advancing/retreating member. However, when a large stroke of the ram is taken to permit tool change, there arises the problem that, in addition to the torque necessary for punching, an extra torque is required for a servo motor for driving the toggle mechanism, etc.

According to the punch driving system of the present invention, a ram stroke for punching is obtained by the bending operation for the first jointed lever which is performed by the advancing/retreating member, and a retraction stroke of the ram for tool change, etc. is obtained by the upper/lower position switchover mechanism.

In the punching operation, with advancing and retreating motions of the advancing/retreating member, the first jointed lever is bent alternately to both sides of its extended position, whereby the ram is moved up and down. In this case, when the advancing/retreating member is located at a stroke end thereof, the ram takes its top dead center position, while when the advancing/retreating member is positioned centrally of its stroke, the ram goes down to its bottom dead center. Further, when the advancing/retreating member advances to the other stroke end, the ram returns to the top dead center. Thus, the up-and-down movement of the ram is performed twice while the advancing/retreating member reciprocates once. Besides, since the stroke of the ram movement by the first jointed lever may be only the stroke required for punching, it is not necessary that the advancing/retreating member be moved a large distance. Therefore, the advance/retreat drive unit for the advancing/retreating member can be driven at an optimum torque, thus making it possible to effect punching at a higher speed.

In the case where a vertically movable lever-like member is used as the fulcrum member and the upper/lower position switchover mechanism is constituted by both a second jointed lever connected to a free end of the fulcrum member and a bend angle changing device connected to a jointed portion of the second jointed lever to change the bend angle, the load working on the fulcrum member under the action of a punching load can be borne by a small force and therefore a simple structure suffices for the upper/lower position switchover mechanism which supports the fulcrum member changeably between upper and lower positions. In other words, although the punching load exerted on the fulcrum member operates on the second jointed lever as a compressive force, the force applied to the bend angle changing device is a very small force because it is a component of force derived from a very small bend angle. For this reason, the bend angle changing device for obtaining the foregoing retraction stroke may be of a simple structure of a small output.

In the case of using a stopper adapted to engage the second jointed lever in a position near the jointed portion of the lever to prevent extension of the lever, there is no fear of the second jointed lever bending inadvertently to the opposite side, and hence it is possible to bear the punching load positively.

DETAILED DESCRIPTION OF PREFERRED EMBODIMENT

Figure 1:
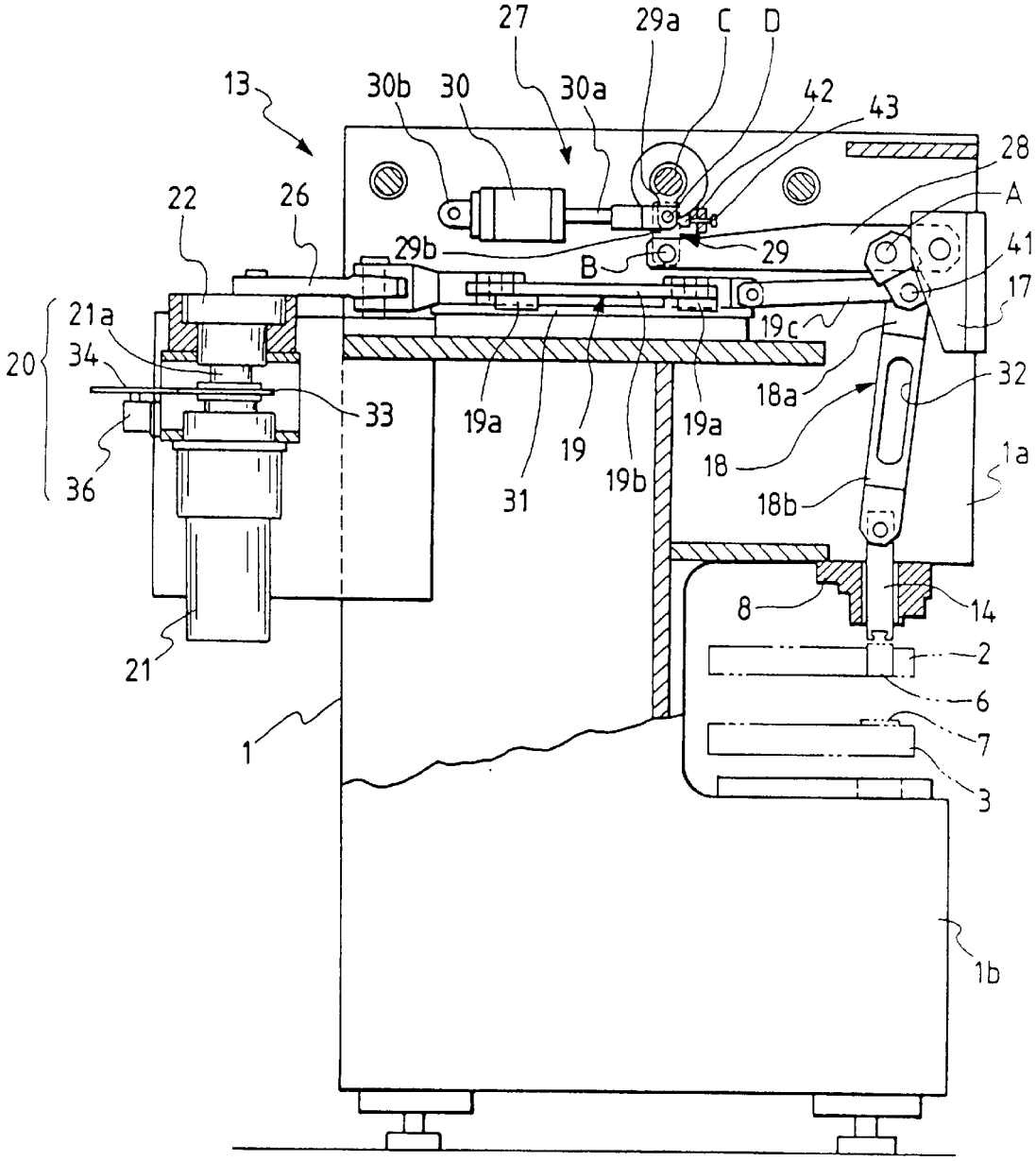
FIG. 1 is a partially cut-away side view of a punch press equipped with a toggle type punch driving system according to an embodiment of the present invention.
Figure 2:
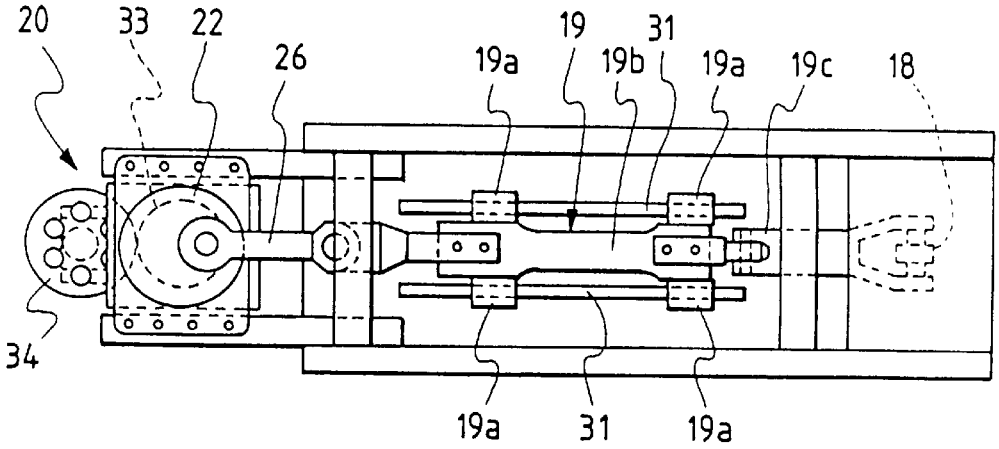
FIG. 2 is a plan view of the toggle type punch driving system.
Figure 3:
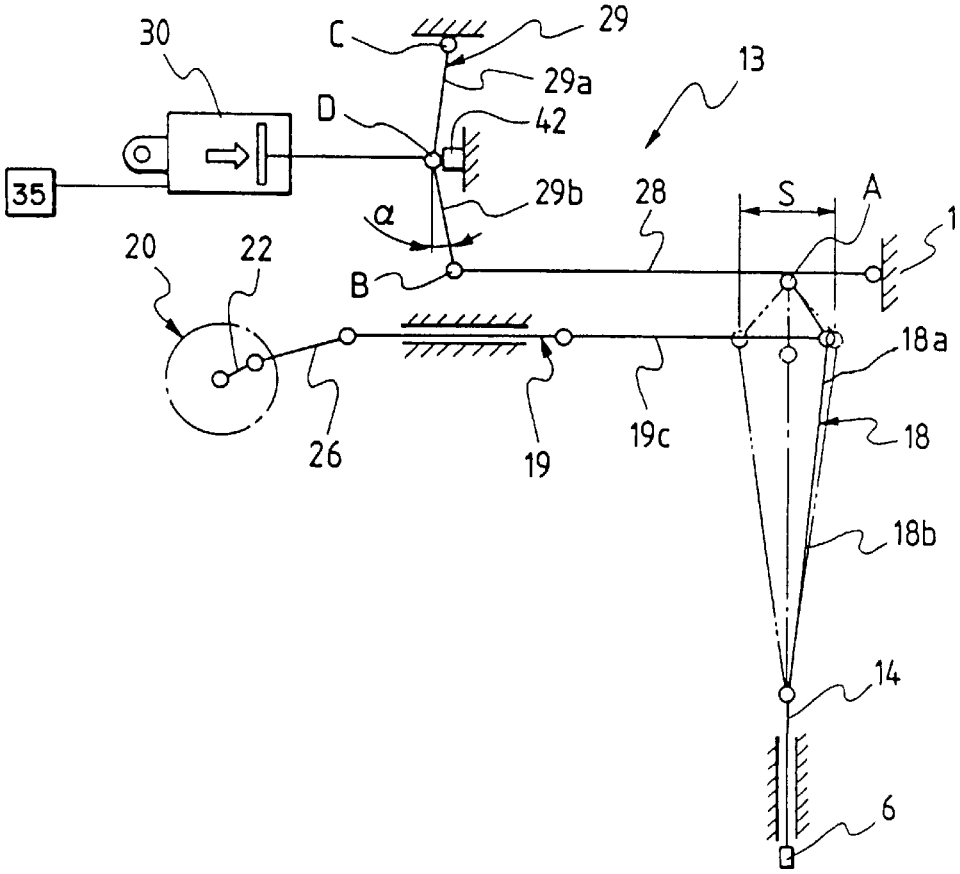
FIG. 3 is a schematic explanatory view of the toggle type punch driving system.

An embodiment of the present invention will now be described with reference to FIGS. 1 to 3. FIG. 1 is a partially cut-away side view of a punch press equipped with a toggle type punch driving system embodying the invention. An upper turret 2 and a lower turret 3 are mounted coaxially with each other to an upper frame portion 1*a* and a lower frame portion 1*b* of a C-shaped frame 1, and a plurality of punch tools 6 and die tools 7 are arranged circumferentially on the upper and lower turrets 2 and 3, respectively. When each punch tool 6 is indexed with respect to the ram position, it is brought into connection with a ram 14 and moved up and down. The ram 14 is supported vertically movable by the upper frame portion la through a guide member 8 and is moved up and down by means of a toggle type punch driving system 13.

In the punch driving system 13, a first jointed lever 18 bends at the jointed portion to cause the ram 14 to move up and down. The bending of the jointed portion of the first jointed level is caused by an advancing/retreating member 19 which can advance and retreat in the horizontal direction. The advancing/retreating member 19 is driven by a crank type advance/retreat drive unit 20 which uses a servo motor 21 as a drive source. The first jointed lever 18 comprises an upper short lever 18*a* and a lower long lever 18*b* which are interconnected bendably at the jointed portion through a pin 41. The lower end of the lower lever 18*b* is pinned to the upper end of the ram 14 pivotably. In the lower lever 18*b* is formed a relief hole 32 which is elongated to the extent of not impairing the strength of the lever to attain the reduction of weight. The upper end of the upper lever 18*a* is pinned to a lever-like fulcrum member 28 pivotably at a fulcrum A. The fulcrum member 28 is mounted at a base end thereof to a bracket 17 of the upper frame portion la in a vertically pivotable manner and is supported by an upper/lower position switchover mechanism 27 which causes the ram 14 to be retracted in an upper position at the time of a tool change for example.

The advancing/retreating member 19 comprises an advance/retreat member body 19*b* and an advance/retreat transfer lever 19*c* connected vertically pivotably to a front end side of the body 19*b*, with a front end of the lever 19*c* being connected vertically pivotably to a pin 41 at the jointed portion of the first jointed lever 18. Vertical displacement of the jointed portion induced with the bending motion of the first jointed lever 18 is absorbed by the vertical swing motion of the advance/retreat transfer lever 19*c*. The body 19*b* is supported for advance and retreat through guide members 19*a* by means of two parallel guide rails 31, 31 (FIG. 2) provided in the upper frame portion 1*a*.

The advance/retreat drive unit 20 is constructed in such a manner that a disk-like crank 22 is mounted on an output shaft 21*a* of a servomotor 21 and that one end of a connecting rod 26 is connected pivotably to the crank 22 in an eccentric position, the opposite end of the connecting rod 26 being connected pivotably to a base end of the advance/retreat member body 19*b*. Separately from a pulse coder (not shown) the servomotor 21 is provided with a detector 36 for detecting a rotational position of the output shaft 21*a* through gears 33 and 34.

The upper/lower position switchover mechanism 27 is provided with a second jointed lever 29, an air cylinder 30 as a bend angle changing device for the lever 29, and a stopper 42. The bend angle changing device is connected to the jointed portion of the second jointed lever in order to change the joint angle. More particularly, the bend angle changing device is connected pivotably to a pin at the jointed portion of the second jointed lever. The second jointed lever 29 comprises an upper lever 29*a* and a lower lever 29*b* which are pinned to each other bendably at a dynamic point D which serves as a jointed portion for bending. The lower end of the lower lever 29*b* is pinned pivotably to a working point B at a rear end of the fulcrum member 28. The upper end of the upper lever 29*a* is supported by the upper frame portion 1*a* pivotably at fulcrum C.

The air cylinder 30 includes a piston rod 30*a*, whose front end is connected pivotably to the pin at the jointed portion of the second jointed lever 29. The body of the air cylinder 30 is supported vertically pivotably at a base end 30*b* thereof by the upper frame portion 1*a*. The stopper 42 is for engagement with the jointed portion of the second jointed lever 29 and it is mounted in the upper frame portion 1*a* through an in/out adjusting mechanism 43 which is constituted by an adjusting screw. The stopper 42 is adjusted beforehand so that the bend angle $\alpha$ at the jointed portion of the second jointed lever 29 is set at a predetermined, very small angle.

A rotatable turret, on which a plurality of punch tools are arranged, is provided. The upper/lower position switchover mechanism 27 raises and retracts the punch tools by moving the first jointed lever from a position, corresponding to the lower position where punching work is processed by the toggle mechanism, to a position corresponding to the upper position where the turret can be rotated to change the punch tool with another one.

According to this construction, the stroke of the ram 14 for punching is assigned to the bending motion of the first jointed lever 18 and the retraction stroke of the ram 14 necessary for tool change, etc. is assigned to the bending motion at the jointed portion of the second jointed lever 29. Thus, a small punching stroke of the ram will do, that is, the torque of the servomotor 21 may be small.

The punching operation is performed in the following manner. As the crank 22 of the advance/retreat mechanism 20 turns once, the advancing/retreating member 19 reciprocates once in both forward and backward directions. In this one reciprocating motion, while the advancing/retreating member 19 shifts from its left-end position in up to a central position of its advance/retreat stroke S, the jointed portion part of the first jointed lever 18 changes from a leftward bent state to an extended state, so that the ram 14 goes down from the top dead center to the bottom dead center. While the advancing/retreating member 19 shifts from the central position of its stroke S to its right-end position, the jointed portion of the first jointed lever 18 changes from the extended state to a rightward bent state, so that the ram 14 goes up from the bottom dead center to the top dead center. Also when the advancing/retreating member 19 returns from its right-end position to its left-end position, the ram 14 moves vertically. In this way, during one reciprocative advance/retreat motion of the advancing/retreating member 19, the ram 14 repeats its up-and-down motion twice, whereby the punching operation using punch tools 6 is performed twice.

In the above punching operation, if the stroke speed of the advancing/retreating member 19 is constant, the stroke speed of the ram 14 becomes lowest in the vicinity of the bottom dead center. However, since the advancing/retreating member 19 is driven by the crank 22, a maximum speed is obtained centrally of the stroke, and the difference between high and low speeds is large. Therefore, after a punch tool 6 has passed through a workpiece, the speed is maintained high in the vicinity of the bottom dead center, so that a high-speed punching can be realized. Moreover, since the drive source for the advancing/retreating member 19 is the servomotor 21, it is easy to make speed control and position control. Consequently, by adjusting the speed and position of the ram according to the thickness and material of each workpiece, it is made possible to improve the machining quality and attain the reduction of noise.

For tool change, the piston rod of the air cylinder 30 in the upper/lower position switchover mechanism 27 is retracted, by an actuating device 35 resulting in that the second jointed lever 29 bends at the jointed portion, the fulcrum member 28 pivots upward, and the first jointed lever 18 rises together with the fulcrum member. Consequently, the ram 14 can be largely raised and retracted, permitting easy execution of the punch tool changing operation.

By keeping the air cylinder 30 normally in its extended state it is possible to bear the punching force as follows. The punching force exerted on the fulcrum A of the first jointed lever 18 for vertical drive is transmitted to the working point B at the rear end of the lever-fulcrum member 28. A push-up force of the working point B is borne by a suitable positional relation between the fulcrum C and dynamic point D of the second jointed lever 29. More particularly, by bending the second jointed lever 29 at the jointed portion only a very small angle $\alpha$ without complete extension, a slight force is applied to the air cylinder 30. Since this force is a component of force created by the slight bend angle $\alpha$ at the jointed portion of the compressive force exerted on the second jointed lever 29, it is a slight force and hence the air cylinder 30 is not required to be a large output. The smaller the bend angle $\alpha$at the jointed portion, the smaller the load required of the air cylinder 30, but if the second jointed lever 29 should bend in the opposite direction, it would become impossible to bear the load. In this connection, however, since the second jointed lever 29 is supported by the stopper 42, it never bends in the opposite direction, so that it is possible to bear the punching load positively at a minimum bend angle $\alpha$ at the jointed portion. In the event an excessive force is applied to the ram 14, a pressure higher than a preset pressure is applied also to the air cylinder 30, whereby the piston is pushed back. In this way there also is attained an overload preventing action.

In the toggle type punch driving system according to the present invention, since there are used a first jointed lever connected at upper and lower ends thereof to a fulcrum member and a ram, respectively, and bendable at an intermediate jointed portion thereof, and an advancing/retreating member connected to the jointed portion of the bendable lever, connected also to an advance/retreat drive unit and adapted to bring the first jointed lever into an extended state at a middle point of its advance/retreat stroke, the ram moves up and down twice during one reciprocative advance/retreat motion of the advancing/retreating member, so that the punching time is shortened.

Moreover, since there is further used an upper/lower position switchover mechanism for switching over the position of the first jointed lever between raised and lowered positions together with the fulcrum member, a suitable retraction stroke of the ram for tool change, etc. can be obtained by the switchover mechanism, and only the stroke required for punching suffices as the moving stroke of the ram by the first jointed lever. Consequently, a servo motor or the like acting as a drive source for the advancing/retreating member can be driven at an optimum stroke, and it becomes possible to effect punching at a higher speed. Besides, the retraction stroke ensured by the upper/lower position switchover mechanism permits easy execution of a tool change, etc.

In the case where the fulcrum member is formed as a vertically pivotable lever and the upper/lower position switchover mechanism is constituted by both a second jointed lever connected to the fulcrum member and a bend angle changing device for the second jointed lever, the load based on punching load and acting on the fulcrum member can be borne by a small force and therefore a simple construction suffices for the upper/lower position switchover mechanism.

Further, in the case of using a stopper which comes into engagement with the second jointed lever to prevent extension of the lever, it is possible to bear the punching load positively while making it possible to switch over the position of the fulcrum member between upper and lower positions by means of the upper/lower position switchover mechanism.

What is claimed is:

1. A toggle type punch driving system, comprising:

a frame;

a ram approximately vertically reciprocatingly disposed for driving punch tools;

a fulcrum member having a first end portion pivotally connected to said frame;

a first jointed lever having an intermediate jointed portion for bending thereof from a minimum bend angle to a maximum bend angle, and having an upper end and a lower end, said upper and lower ends being pivotally connected to said fulcrum member and said ram, respectively;

an advancing/retreating means for advancing and retreating through a plurality of advance/retreat strokes, said advancing/retreating means being connected to said intermediate jointed portion of said first jointed lever and to an advancing/retreating drive unit, wherein said first jointed lever is at said minimum bend angle and in a fully extended position halfway through any one of said plurality of advance/retreat strokes of said advancing/retreating means and wherein said advancing/retreating drive unit comprises a servomotor having an output shaft, a crank mounted on said output shaft of said servomotor, and a connecting rod having first and second ends, wherein said first end is pivotally and eccentrically connected to said crank and said second end is pivotally connected to said advancing/retreating means;

an upper/lower position switchover means for pivoting said fulcrum member and switching over said upper end of said first jointed lever from a raised position to a lowered position and from said lowered position to said raised position; and a rotatable turret supported by said frame and having a plurality of said punch tools arranged thereon, wherein said ram is connected to at least one of said plurality of punch tools and said upper/lower position switchover means raises said ram by pivoting said fulcrum member in a first direction and moving said upper end of said first jointed lever from said lowered position, where said punch is in operating position and a punching operation can be performed, to said raised position, where said ram is spaced from said turret and said turret is capable of rotating so that a tool changing operation can be performed;

whereby said upper/lower switchover means pivots said fulcrum member in said first direction and switches over said upper end of said first jointed lever to said raised position to perform said tool changing operation, and whereby said upper/lower switchover means pivots said fulcrum member in a second direction and switches over said upper end of said first jointed lever to said lowered position to perform said punching operation, and whereby, during said punching operation, the selected at least one punch tool is continuously worked by an advancing/retreating movement of said first jointed lever by said plurality of advance/retreat strokes of said advancing/retreating means so that said punching operation performed by said at least one punch tool is a high speed machining operation.

2. The toggle type punch driving system as recited in claim 1, wherein said upper/lower position switchover means comprises a second jointed lever having a lower end thereof pivotally connected to a free end of said fulcrum member and also having an upper end thereof pivotally connected to said frame, said second jointed lever being bendable at an intermediate jointed portion thereof, and a bend angle changing means connected to said intermediate jointed portion of said second jointed lever so as to change a second bend angle at which said jointed portion of said second jointed lever is bent from a minimum second bend angle to a maximum second bend angle.

3. The toggle type punch driving system as recited in claim 2, further comprising a stopper mounted adjacent to said jointed portion of said second jointed lever for limiting bending of said second jointed lever in one direction such that said stopper is engaged with said second jointed lever at said maximum second bend angle which is only slightly greater than said minimum second bend angle.

4. The toggle type punch driving system as recited in claim 3, wherein said stopper is mounted on said frame through an in/out adjusting means, whereby said stopper is adjusted so that said maximum second bend angle of said second jointed lever is set at a predetermined small angle which is only slightly greater than said minimum second bend angle.

5. The toggle type punch driving system as recited in claim 2, wherein said bend angle changing means includes an air cylinder pivotally connected to a pin which is part of said intermediate jointed portion of said second jointed lever.

* * * * *